US005259798A

United States Patent [19]

Runckel

[11] Patent Number: 5,259,798

[45] Date of Patent: Nov. 9, 1993

[54] SWIM FIN

[75] Inventor: John L. Runckel, Lake Oswego, Oreg.

[73] Assignee: John L. Runckel Trust, John L. Runckel and Markie W. Runckel, Cotrustees, Portland, Oreg.

[21] Appl. No.: 730,129

[22] Filed: Jul. 15, 1991

[51] Int. Cl.[5] ..... A63B 31/11

[52] U.S. Cl. ..... 441/64

[58] Field of Search ..... 441/55, 61-65, 441/75; D21/239

[56] References Cited

U.S. PATENT DOCUMENTS

| | | | |
|---|---|---|---|
| 1,793,937 | 2/1931 | Knudsen | 441/61 |
| 2,903,719 | 9/1959 | Wozencraft . | |
| 3,107,372 | 10/1963 | Brown et al. | 441/64 |
| 3,112,503 | 12/1963 | Girden | 441/64 |
| 3,239,857 | 3/1966 | Gwynne | 441/64 |
| 3,952,351 | 4/1976 | Gisbert . | |
| 4,521,220 | 6/1985 | Schoofs . | |
| 4,778,423 | 10/1988 | Ciccotelli . | |
| 4,884,986 | 12/1989 | Gil . | |
| 4,889,510 | 12/1989 | Piatt . | |
| 4,940,437 | 7/1990 | Piatt | 441/64 |
| 4,948,385 | 8/1990 | Hall . | |
| 4,952,183 | 8/1990 | Gil . | |
| 4,973,049 | 11/1990 | Ciolino . | |

*Primary Examiner*—David M. Mitchell
*Assistant Examiner*—Stephen P. Avila
*Attorney, Agent, or Firm*—Kolisch Hartwell Dickinson McCormack & Heuser

[57] ABSTRACT

A swim fin which comprises a unitary member having a foot region, a blade region and a device for securing the foot of a swimmer to the swim fin. The swim fin includes an expanse of water-buoyant material which provides for a swim fin which is water-buoyant as a whole. The swim fin is designed such that it may be easily applied to a user's foot and comfortably used both in and out of the water.

5 Claims, 3 Drawing Sheets

FIG. 5
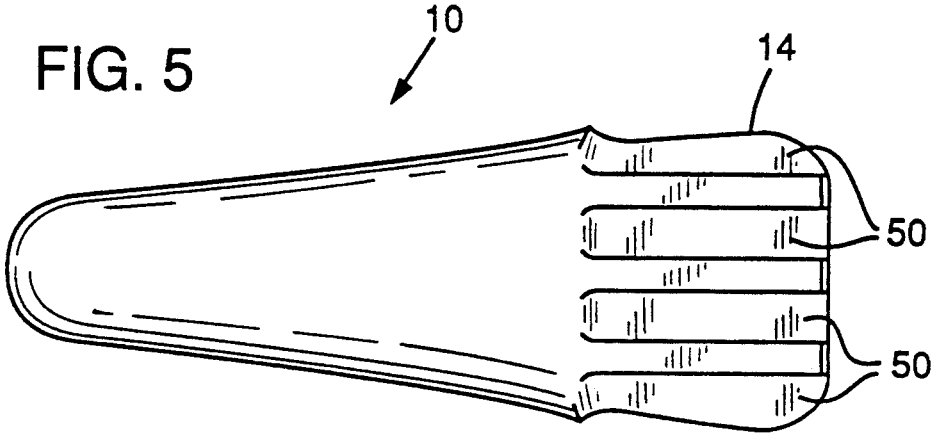
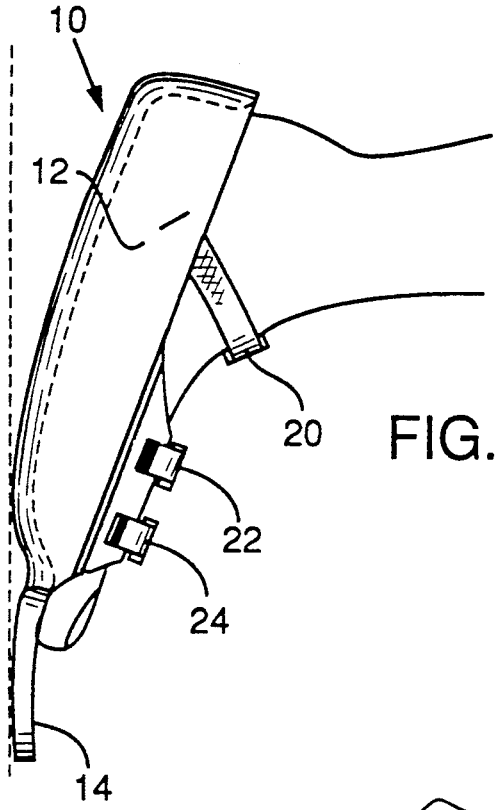
FIG. 6
FIG. 7
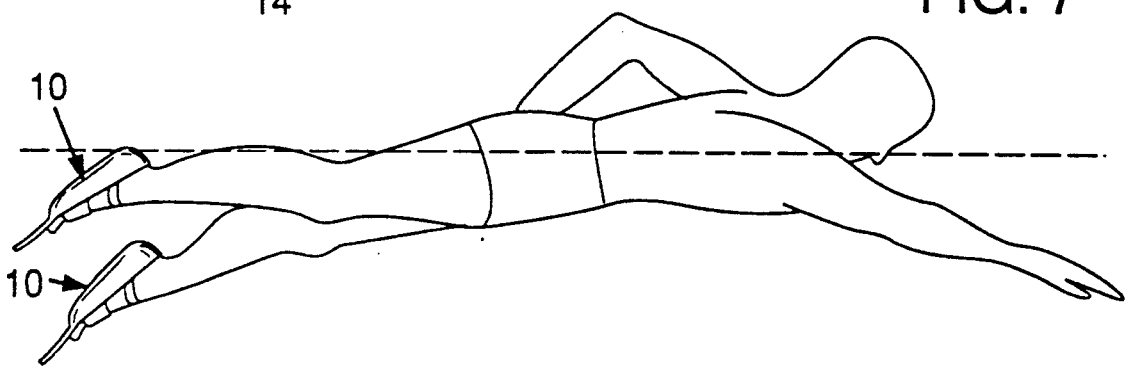

SWIM FIN

BACKGROUND AND SUMMARY OF THE INVENTION

This invention relates generally to swim fins and, more particularly, to a water-buoyant swim fin which is suitable for use in propelling a swimmer through the water.

The sport of swimming serves as an increasingly popular form of both recreation and exercise, attracting persons of diverging levels of physical ability. Despite their interest, many of these swimmers never receive formal swimming instruction and, consequently, never develop proper swimming technique. Even swimmers who have had training may fail to use proper technique, being unable to achieve a proper body position due to a lack of physical strength or flexibility. Consequently, it is not uncommon to find a swimmer using improper swimming technique.

When using proper technique, a swimmer's body should approach a plane parallel to the surface of the water. The higher the swimmer's body planes in the water, the faster the swimmer is able to go. When the swimmer's body is in an improper position, however, it provides increased water resistance, slowing the swimmer's forward progress. An improper body position is often the result of fatigue, swimmers tending to drag the rearward portion of their bodies through the water when they are tired. As a result, swimmers' arms may enter the water at an unnatural angle, increasing the risk of injury to the swimmer's shoulders. By using a proper technique, swimmers are able to achieve proper body position, resulting in maximum forward progress without undo risk of shoulder injury.

One method of achieving proper body position involves flutter kicking by the swimmer, the upward force provided by such a kick tending to raise the swimmer's body to a near parallel plane with the surface of the water. To aid in this endeavor, various swim fin designs have been made commercially available, such fins having generally been designed to increase the force exerted by each downward thrust of the swimmer's leg. These fins, however, do nothing to compensate for fatigue or for a lack of physical conditioning, either of which may lead to dragging of the swimmer's feet. Many of these swim fins actually interfere with the swimmer's ability to flutter kick, fin size making it difficult to kick without collision of the fins.

Conventional swim fins, as described above, are typically formed from a molded rubber material, providing swimmers with heavy, non-water-buoyant fins. Such fins may add to swimmer fatigue, the weight of the fins increasing the drag on a swimmer's feet and, consequently, slowing the swimmer's progress Non-water-buoyant fins may also be difficult to retrieve should a fin become dislodged from the swimmer's foot. In such a situation, the fin would sink to the bottom, making it difficult, if not impossible, to reach.

Another problem with presently available swim fins concerns the use of such fins on land. When leaving the water, a swimmer may desire to walk about without removing the fins, the swimmer intending for the fins to provide protection against hazards such as sharp objects or hot sand. Presently available fins, however, provide only partial protection, leaving large sections of a swimmer's foot uncovered or protected only by a thin layer of material. Due to their cumbersome designs, such fins may also prove to be completely unsuitable for use out of the water, it being difficult to walk about while wearing the fins.

Yet another problem with conventional swim fins involves the difficulty with which such fins are applied to the user's foot. Most of such fins are applied by sliding the foot forwardly into a cavity defined by the swim fin. The fin is then secured to the foot by a strap, commonly extending around the swimmer's heel. To ensure a tight fit, it may be necessary to slide the user's foot into a tight-fitting fin such an operation tending to pull the user's skin, resulting in discomfort of the swimmer.

In view of the above-described problems, it is an object of this invention to provide a swim fin which, when worn on a swimmer's foot, promotes proper swimming technique.

It is also an object of this invention to provide a swim fin which is water-buoyant, use of the fin tending to reduce the effect of fatigue on a swimmer.

It is another object of this invention to provide a fin which may be comfortably worn on land to protect a swimmer's foot against hazard.

It is yet another object of this invention to provide a fin which may be comfortably applied to a swimmer's foot.

The above-described objects as well as other objects and advantages of the present invention will become more fully apparent as the description that follows is read in conjunction with the drawings.

BRIEF DESCRIPTION OF THE DRAWINGS

FIG. 5 is a bottom view of the swim fin embodiment of FIG. 1.

FIG. 6 is a side view of the swim fin embodiment of FIG. 1 illustrating the swim fin as it is used to push off against a side wall.

FIG. 7 is a view illustrating use of a pair of the invented swim fins by a swimmer swimming on the surface of the water.

DETAILED DESCRIPTION OF THE PREFERRED EMBODIMENT

As stated above, the present invention relates to a water-buoyant swim fin which may be used to promote propulsion of a swimmer through the water. Although, the fin is particularly suitable for use in the water, it is also suitable for use on land to protect a swimmer's foot from hazard.

Figure 1:
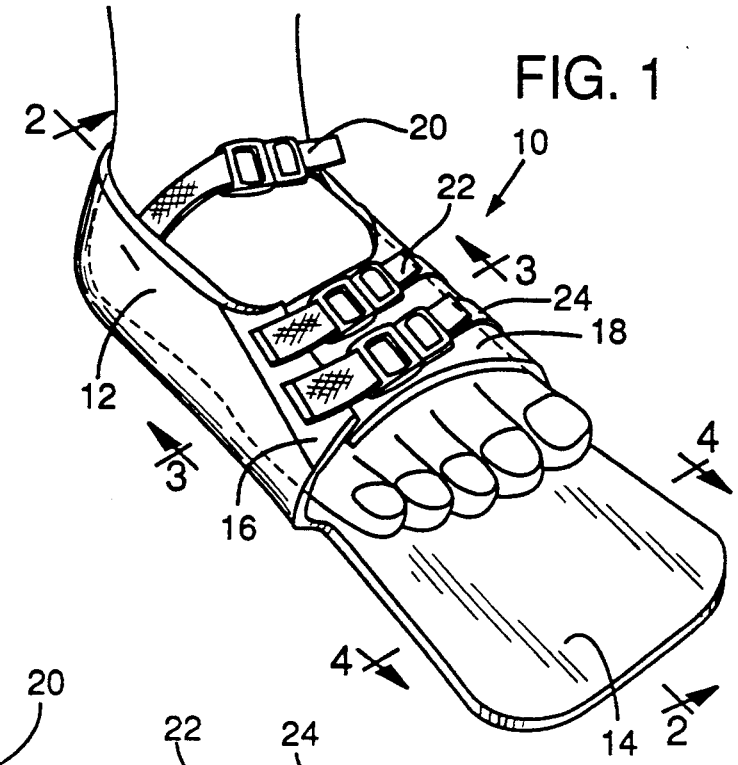
FIG. 1 is a perspective view of a preferred embodiment of the invented swim fin, the fin being secured to a swimmer's foot.

Referring first to FIG. 1, a preferred embodiment of the swim fin has been depicted, the fin being indicated generally at 10. As shown, swim fin 10 includes a unitary shoe-like member having a foot region 12, a blade region 14, and a pair of flaps 16, 18. A plurality of straps 20, 22, 24 extend from the shoe-like member, the straps acting in concert with flaps 16 and 18 to secure the swim fin to a user's foot.

Figure 2:
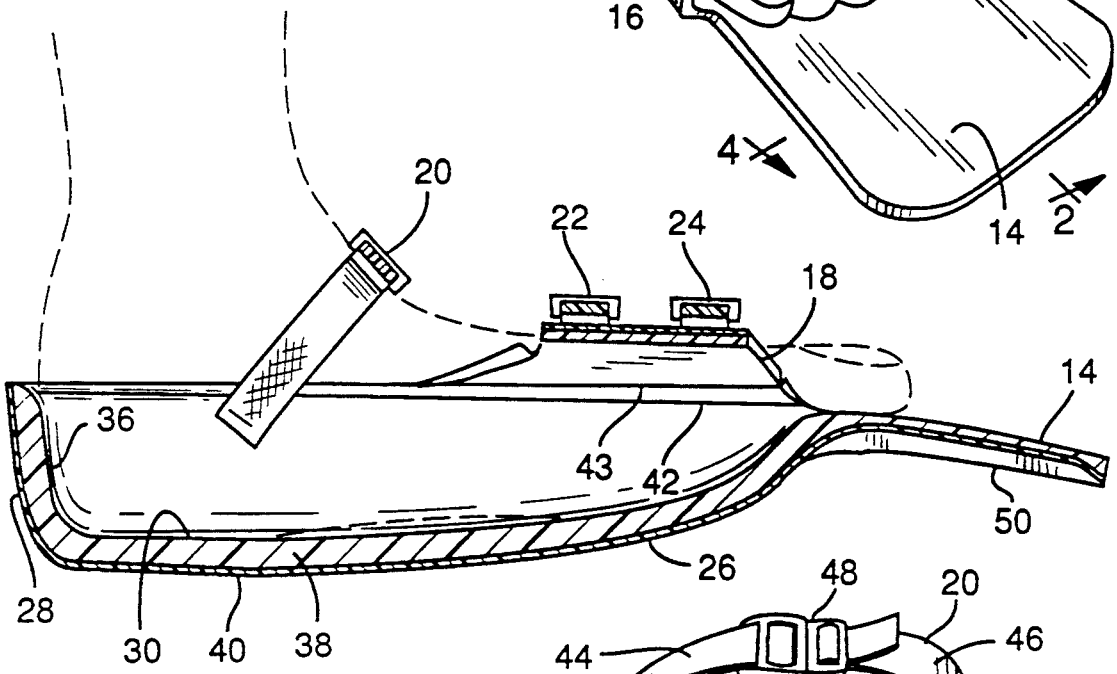
FIG. 2 is a sectional elevational view taken generally along line 2—2 of FIG. 1, the swimmer's foot being shown by dashed lines.
Figure 3:
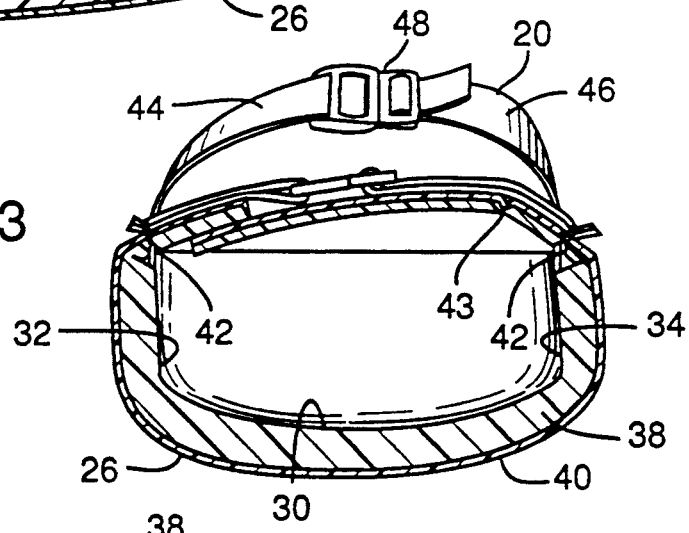
FIG. 3 is a sectional view taken generally along line 3—3 of FIG. 1.

Focusing attention initially on FIGS. 2 and 3, swim fin 10 is shown having an elongate foot region the foot region including an elongate sole section 26. Sole section 26 substantially extends the length of the foot region, the foot region having a predetermined length approximating the length of a user's foot. As shown, the sole section is trough-shaped, having a floor 30 and a pair of spaced side walls 32, 34. Both the floor and the side walls extend the length of the sole section.

As shown, floor 30 is adapted to extend in a plane underlying the user's foot. To provide for a comfortably fitting fin, the floor may consequently be contoured to generally fit the undersurface of the user's foot. Toward this end, the floor of the depicted fin curves upward along a portion of its perimeter, the forwardmost portion of the floor forming a smooth transition to the blade region. The edges of the floor similarly curve upward along a portion of the floor's length.

Referring now specifically to FIG. 3, it may be seen that the width of the floor approximates the width of the user's foot, the sole section having a predetermined maximum width which approximates the width of the floor at its widest point. Each of the side walls 32, 34 project from the floor in a direction generally normal thereto. The sole section therefore cradles the user's foot, the floor supporting the user's foot from below and the side walls extending along the sides of the user's foot to prevent side-to-side movement of the foot with respect to the floor.

Referring again to FIG. 2, one will note that foot region 12 also includes a heel section 28. As shown, heel section 28 extends from the rear of the sole section, providing a fin which is adapted to receive a user's foot in a manner similar to the manner in which a shoe receives a foot. Toward this end, the heel section is cupped, having a back wall 36. The back wall extends out of the floor and side walls of the foot region such that it wraps around the user's heel. The heel section thus prevents rearward sliding movement of the user's foot relative to the sole section.

Continuing with the description of the shoe-like member, and referring expressly to the flaps as depicted in FIG. 3, it should be noted that flap 16 is pivotally extendable from side wall 32 and flap 18 is pivotally extendable from side wall 34. The flaps are pivotable along notches 42, which define a line of intersection between adjacent flaps and side walls. The flaps are movable between an open configuration and a closed configuration as is hereinafter described.

When in the open configuration, the foot region defines an opening which spans the entire length of the sole section. To apply the fin to the user's foot, the foot is passed downwardly through the opening and into the foot region without obstruction. The foot may thereafter be slid rearwardly into engagement with back wall 36, seating the foot. Once the user's foot is seated in the foot region, the flaps are pivoted into the closed configuration, the flaps, in combination with the sole section, encircling the instep of the user's foot. As shown in FIG. 3, the flaps may overlap, the swim fin therefore being suitable for use on feet of various sizes. In order to ensure a comfortable fit over the instep of the user's foot, additional notches, such as notch 43 in FIG. 3, may be provided. Such notches provide lines along which the flaps are bendable.

Referring now to FIGS. 1, 2 and 3, it will be understood that flaps 16 and 18 may be maintained in the above-described closed configuration by suitable fastening means such as straps 22 and 24. The user's instep is thereby held within the sole section. A similar strap 20 may extend over the user's foot in the area of the user's ankle to prevent disassociation of the heel section from the user's heel. The flaps, in combination with the abovedescribed straps act as retaining means, securing the shoe-like member to the user's foot. As shown, each strap may include a pair of elongate belts 44, 46, the straps being detachably connected together at a buckle 48. The straps may be secured to the foot region by suitable means such as by stitching. The straps may be effectively adjustable in length to ensure a tight fit over the flaps.

Turning now to a discussion of blade region 14, as shown in FIGS. 1, 2 and 5, one will notice that the blade region extends forwardly from foot region 12. As shown, blade 14 is a substantially rectangular projection, increasing the effective size of the user's foot only minimally. The blade has a length of not more than approximately ½ the length of sole section 26, the blade extending from the sole section in a plane substantially parallel to the plane of the user's toes. As indicated, the user's toes rest on the blade to provide improved user comfort. The width of the blade region approximates the maximum width of the foot region. For this reason, the user may flutter kick without collision of the blades. The user may also walk while wearing the fins without stepping on the blades. Consequently, the fins may be comfortably used on land.

Figure 4:
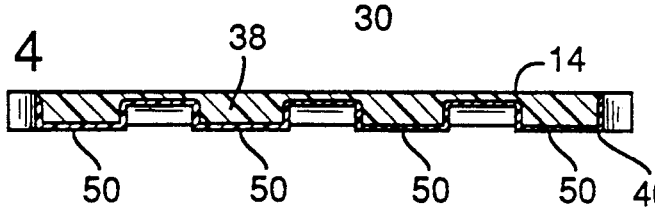
FIG. 4 is a sectional view taken generally along line 4—4 of FIG. 1.
Figure 8:
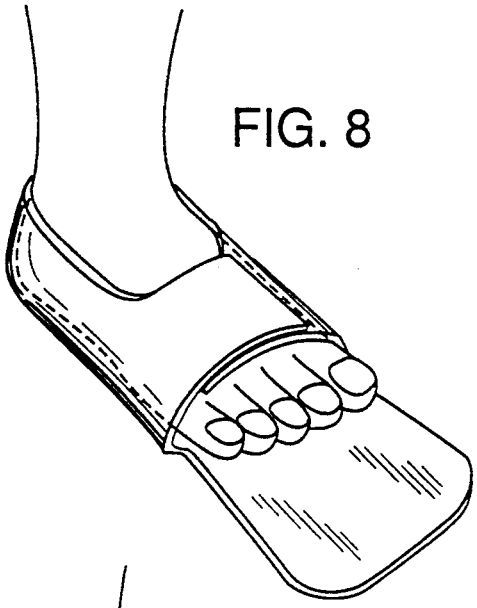
FIG. 8 is a perspective view of an alternative embodiment of the invented swim fin.
Figure 9:
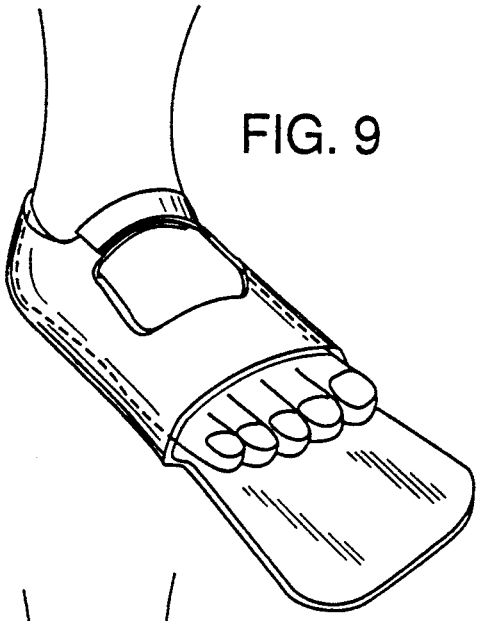
FIG. 9 is a perspective view of another alternative embodiment of the invented swim fin.
Figure 10:
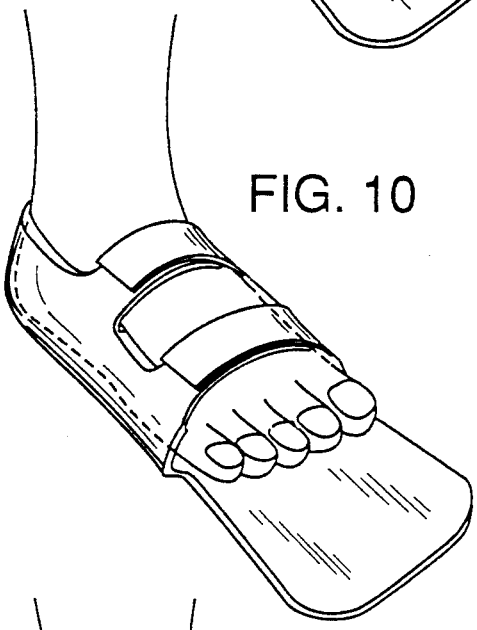
FIG. 10 is a perspective view of another alternative embodiment of the invented swim fin.
Figure 11:
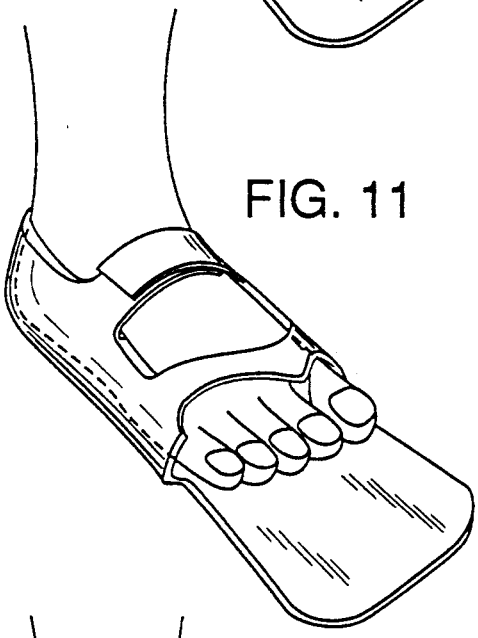
FIG. 11 is perspective view of another alternative embodiment of the invented swim fin.
Figure 12:
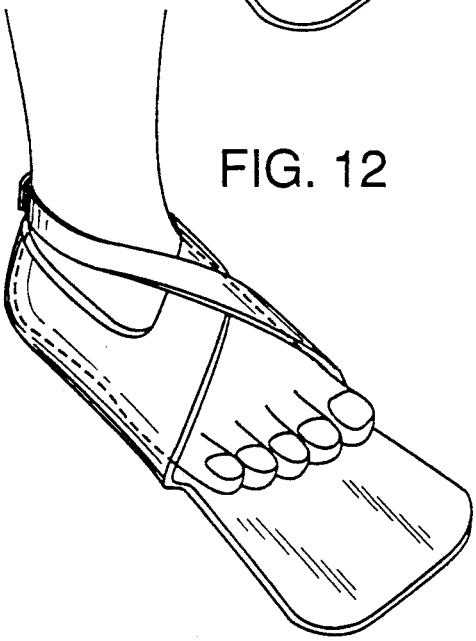
FIG. 12 is a perspective view of yet another alternative embodiment of the invented swim fin.
Figure 13:
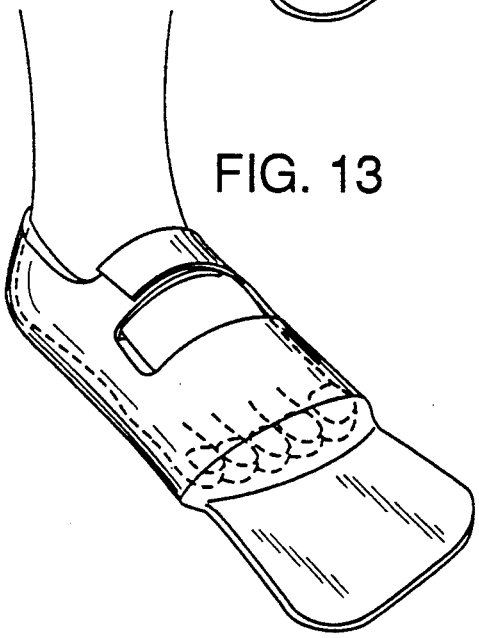
FIG. 13 is a perspective view of still another embodiment of the invented swim fin.

In FIGS. 4 and 5, a further attribute of blade region 14 is shown, the blade defining a plurality of ridges 50. The ridges are intended to provide longitudinal integrity to the blade. Preferably, the blade will be stiff but not rigid, being bendable to a 45 degree angle relative to its at rest position under a force of approximately two pounds. It is desired that the blade will therefore provide an effective force against the water across its entire surface during swim fin use.

Bringing FIG. 6 into the discussion, a particular advantage of the above-described swim fin is illustrated, the fin being depicted in its use to push off against a side wall of a pool. Because the above-described fin is provided with a stiff blade region, the force exerted when pushing off against a surface to begin propulsion through the water is readily applied against the surface through the blade. Due to the small size of the blade, users will also have a better feel for how much force they are applying to the surface and for how that force is being applied. In addition, the small size of the blade region provides a fin which may be easily brought around and positioned against the wall.

Turning now to a discussion of the composition of the swim fin and referring particularly to FIGS. 2, 3 and 4, one will note that the above-described shoe-like member includes an expanse of water-buoyant material 38. As shown, expanse 38 may span the entire shoe-like member it being desired that such expanse provide a swim fin which is water-buoyant as a whole. Although the expanse is referred to generally as being water-buoyant, it is to be understood that the fin is to be buoyant in fresh water, ocean water or in any other fluid suitable for swimming. Consequently, expanse 38 is preferably composed of a light-weight foam having a specific gravity of approximately 10% the specific gravity of water.

To further improve the comfort of the fin, the water-buoyant material of expanse 38 may be resilient, being easily depressible by the thumb of the user. Where expanse 38 spans the entire sole section, as shown, swim fin users are provided with a cushion underlying each foot. Such cushion may provide for comfortable walking, the expanse particularly improving comfort when walking on jagged surfaces or hot sand.

Referring still to FIGS. 2, 3 and 4, one will further notice that an outer shell 40 partially coats expanse 38. Although, in the depicted embodiment, outer shell 40 only partially coats expanse 38 it will be understood that the expanse may be completely covered without departing from the scope of the invention as claimed. Like expanse 38, shell 40 is preferably composed of a water-buoyant material such as a light-weight foam. Shell 40, however, is more rigid than the resilient material of expanse 38. In the preferred embodiment, for example, the shell is difficult to depress under urging of a user's thumb. Because, as depicted, shell 40 coats the exterior of the shoe-like member, resistance to abrasion of the user's foot and of the water-buoyant expanse is provided. Where shell 40 is substantially rigid, it may also provide the shoe-like member with structural integrity.

Referring to FIG. 7 for a moment, the effect of using a water-buoyant swim fin may be illustrated. In FIG. 7, the depicted swimmer is shown using proper swimming technique, the swimmer's body moving through the water in a plane near parallel to the water's surface. By using fins which are water-buoyant, the swimmer is able to readily achieve such a position, the swim fins tending to float the swimmer's feet. This in turn leads to use of a more natural swimming motion, reducing the risk of injury to the swimmer.

FIGS. 8 through 13 represent various alternative embodiments of the present invention, each of the depicted swim fins employing a unitary member including a foot region, a blade region and a pair of overlapping flaps. In the depicted alternative embodiments, the flaps are secured in position by fastening means which employ cooperating adhesive elements such as Velcro TM. The straps are maintained in overlapping relationship using such fastening means, the foot thereby being retained within the foot region.

Accordingly, while a preferred embodiment of the invention has been disclosed, it should be appreciated that variations and modifications may be made without departing from the scope of the invention as defined by the claims.

It is claimed and desired to secure by Letters Patent:

1. A swim fin comprising:

a foot region including a cupped heel and an elongate sole section having a floor and a pair of upstanding side walls which extend substantially the length of the sole section to cradle a user's foot said foot region defining an opening which spans the length of said sole section to provide for unobstructed downward, rearward placement of the user's foot into said foot region;

a blade region extending generally forwardly from said sole section; and retaining means for securing the swim fin to the user's foot.

2. A swim fin comprising:

a unitary shoe-like member including (a) a foot region having a cupped heel section and an elongate trough-shaped sole section having a length approximating the length of a user's foot, said sole section extending forwardly from said heel section, (b) an elongate blade region extending forwardly from said sole section not more than approximately one half the length of said sole section and (c) first and second pivotable flaps extending from said sole section, said flaps being configurable to, in combination with said sole section, encircle the user's foot to secure the user's foot within said foot region; and fastening means for maintaining said flaps in said configuration encircling the user's foot;

said foot region, blade region and flaps of said shoe-like member being composed of a water-buoyant material to provide for the water-buoyancy of the swim fin as a whole.

3. The swim fin of claim 2 wherein said fastening means includes a strap.

4. The swim fin of claim 2 wherein said fastening means includes an adhesive element, said adhesive element being fixed to one of said flaps, said flaps overlapping to adhere to one another.

5. A swim fin comprising:

a unitary shoe-like member including (a) a foot region having a cupped heal section and a trough-shaped sole section with a floor and a pair of upstanding side walls, said sole section extending forwardly from said heal section a predetermined length for cradling a user's foot, and (b) a blade region extending forwardly from said sole section; and retaining means for securing the swim fin to the user's foot;

said shoe-like member including a water-buoyant expanse extending substantially throughout said cupped heal section, said trough-shaped sole section and said blade region.

* * * * *